US007759869B2

(12) United States Patent
Kim et al.

(10) Patent No.: US 7,759,869 B2
(45) Date of Patent: Jul. 20, 2010

(54) PLASMA DISPLAY PANEL

(75) Inventors: Heekwon Kim, Gumi (KR); Byunghyun Kim, Gumi (KR)

(73) Assignee: LG Electronics Inc., Seoul (KR)

( * ) Notice: Subject to any disclaimer, the term of this patent is extended or adjusted under 35 U.S.C. 154(b) by 164 days.

(21) Appl. No.: 12/040,956

(22) Filed: Mar. 3, 2008

(65) Prior Publication Data

US 2009/0102381 A1 Apr. 23, 2009

(30) Foreign Application Priority Data

Oct. 18, 2007 (KR) ..... 10-2007-0105017

(51) Int. Cl.
*H01J 17/49* (2006.01)

(52) U.S. Cl. ..... 313/586

(58) Field of Classification Search ..... 313/582–587
See application file for complete search history.

(56) References Cited

U.S. PATENT DOCUMENTS 6,614,165 B1 * 9/2003 Aoki et al. ..... 313/485
2005/0025362 A1 2/2005 Blair
2005/0093450 A1 5/2005 Yoon
2005/0110412 A1 5/2005 Lee

FOREIGN PATENT DOCUMENTS

JP 2002-324492 A 11/2002
KR 10-2005-0066570 A 6/2005

OTHER PUBLICATIONS

Korean International Search Report, Written Opinion and Notification of Transmittal of Search Report dated Aug. 27, 2008 for Application No. PCT/KR2008/002360, 14 pages.

* cited by examiner

*Primary Examiner*—Karabi Guharay
*Assistant Examiner*—Brenitra M Lee
(74) *Attorney, Agent, or Firm*—Fish & Richardson P.C.

(57) ABSTRACT

A plasma display panel is disclosed. The plasma display panel includes a front substrate, a rear substrate, a phosphor layer and a barrier rib between the front and rear substrates, and a discharge gas filled between the front and rear substrates. The phosphor layer includes a phosphor material and an additive material. The additive material includes at least one of magnesium oxide (MgO), zinc oxide (ZnO), silicon oxide ($SiO_2$), titanium oxide ($TiO_2$), yttrium oxide ($Y_2O_3$), aluminum oxide ($Al_2O_3$), lanthanum oxide ($La_2O_3$), europium oxide (EuO), cobalt oxide, iron oxide, or CNT (carbon nano tube). A pressure of the discharge gas lies substantially in a range between 400 torr and 500 torr.

26 Claims, 10 Drawing Sheets

| | Comparative example | Experimental example 1 | Experimental example 2 | Experimental example 3 |
|---|---|---|---|---|
| Firing voltage | 135V | 128V | 129V | 127V |
| Luminance | 170(cd/$m^2$) | 176(cd/$m^2$) | 178(cd/$m^2$) | 177(cd/$m^2$) |
| Contrast ratio | 55:1 | 60:1 | 58:1 | 61:1 |

FIG. 10

| Gas pressure (torr) | Noise (dB) | | | | | |
|---|---|---|---|---|---|---|
| | 500Hz | 1 KHz | 2 KHz | 4 KHz | 8 KHz | 16 KHz |
| 400 | 16.1 | 16 | 15.4 | 13.7 | 12.4 | 10.5 |
| 420 | 16.6 | 18.6 | 18.8 | 17.2 | 16.7 | 16.3 |
| 460 | 16.2 | 18 | 18.2 | 17.7 | 17.4 | 17.1 |
| 500 | 17.7 | 18.9 | 19.1 | 19.2 | 19.5 | 19.7 |
| 550 | 20.7 | 22.4 | 21.8 | 27.4 | 35.3 | 34 |
| 600 | 27.6 | 28.2 | 26.9 | 31.2 | 33.4 | 34.1 |

PLASMA DISPLAY PANEL

This application claims the benefit of Korean Patent Application No. 10-2007-0105017 filed on Oct. 18, 2007 which is hereby incorporated by reference.

BACKGROUND

1. Field

An exemplary embodiment relates to a plasma display panel.

2. Description of the Background Art

A plasma display panel includes a phosphor layer inside discharge cells partitioned by barrier ribs and a plurality of electrodes.

When driving signals are applied to the electrodes of the plasma display panel, a discharge occurs inside the discharge cells. In other words, when the plasma display panel is discharged by applying the driving signals to the discharge cells, a discharge gas filled in the discharge cells generates vacuum ultraviolet rays, which thereby cause phosphors positioned between the barrier ribs to emit light, thus producing visible light. An image is displayed on the screen of the plasma display panel due to the visible light.

SUMMARY

In one aspect, a plasma display panel comprises a front substrate, a rear substrate positioned opposite the front substrate, a phosphor layer positioned between the front substrate and the rear substrate, a barrier rib positioned between the front substrate and the rear substrate, and a discharge gas filled between the front substrate and the rear substrate, wherein the phosphor layer includes a phosphor material and an additive material, the additive material includes at least one of magnesium oxide (MgO), zinc oxide (ZnO), silicon oxide ($SiO_2$), titanium oxide ($TiO_2$), yttrium oxide ($Y_2O_3$), aluminum oxide ($Al_2O_3$), lanthanum oxide ($La_2O_3$), europium oxide (EuO), cobalt oxide, iron oxide, or CNT (carbon nano tube), and a pressure of the discharge gas lies substantially in a range between 400 torr and 500 torr.

In another aspect, a plasma display panel comprises a front substrate, a rear substrate positioned opposite the front substrate, a phosphor layer positioned between the front substrate and the rear substrate, a barrier rib positioned between the front substrate and the rear substrate, and a discharge gas filled between the front substrate and the rear substrate, wherein the phosphor layer includes a phosphor material and an additive material, the additive material includes at least one of magnesium oxide (MgO), zinc oxide (ZnO), silicon oxide ($SiO_2$), titanium oxide ($TiO_2$), yttrium oxide ($Y_2O_3$), aluminum oxide ($Al_2O_3$), lanthanum oxide ($La_2O_3$), europium oxide (EuO), cobalt oxide, iron oxide, or CNT (carbon nano tube), a pressure of the discharge gas lies substantially in a range between 400 torr and 500 torr, and the discharge gas includes xenon (Xe) of 10% to 30% based on weight of the discharge gas.

In still another aspect, a plasma display panel comprises a front substrate, a rear substrate positioned opposite the front substrate, a phosphor layer positioned between the front substrate and the rear substrate, a barrier rib positioned between the front substrate and the rear substrate, and a discharge gas filled between the front substrate and the rear substrate, wherein the phosphor layer includes a phosphor material and MgO material, and a pressure of the discharge gas lies substantially in a range between 400 torr and 500 torr.

BRIEF DESCRIPTION OF THE DRAWINGS

The accompanying drawings, which are included to provide a further understanding of the invention and are incorporated on and constitute a part of this specification, illustrate embodiments of the invention and together with the description serve to explain the principles of the invention. In the drawings:

FIG. 10 is a table showing a relationship between a pressure of a discharge gas and a noise;

DETAILED DESCRIPTION

Reference will now be made in detail embodiments of the invention examples of which are illustrated in the accompanying drawings.

Figure 1:
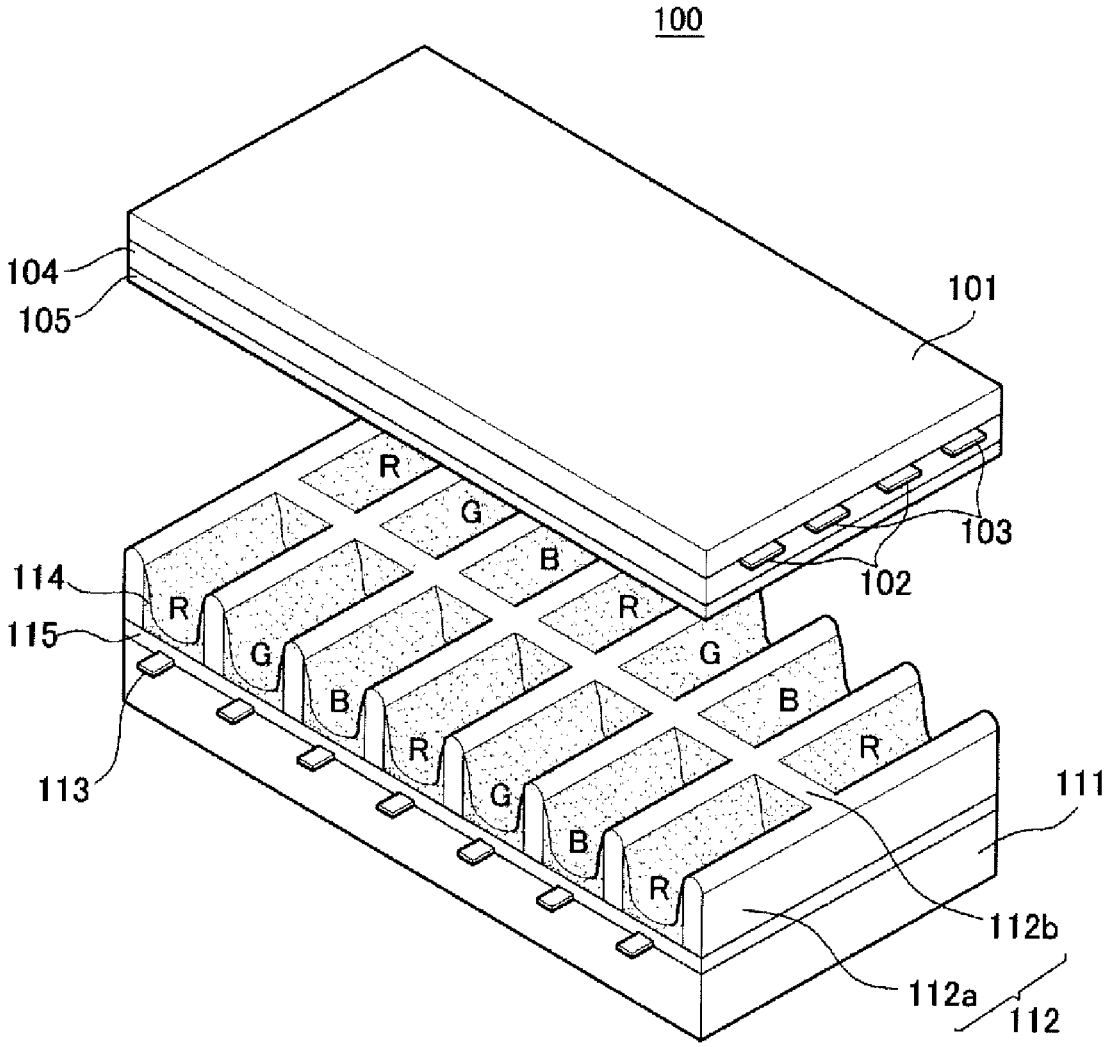
FIG. 1 shows a structure of a plasma display panel according to an exemplary embodiment.

FIG. 1 shows a structure of a plasma display panel according to an exemplary embodiment.

As shown in FIG. 1, a plasma display panel 100 according to an exemplary embodiment may include a front substrate 101, on which a scan electrode 102 and a sustain electrode 103 are positioned parallel to each other, and a rear substrate 111 on which an address electrode 113 is positioned to intersect the scan electrode 102 and the sustain electrode 103.

An upper dielectric layer 104 may be positioned on the scan electrode 102 and the sustain electrode 103 to limit a discharge current of the scan electrode 102 and the sustain electrode 103 and to provide electrical insulation between the scan electrode 102 and the sustain electrode 103.

A protective layer 105 may be positioned on the upper dielectric layer 104 to facilitate discharge conditions. The protective layer 105 may include a material having a high secondary electron emission coefficient, for example, magnesium oxide (MgO).

A lower dielectric layer 115 may be positioned on the address electrode 113 to cover the address electrode 113 and to provide electrical insulation of the address electrodes 113.

Barrier ribs 112 of a stripe type, a well type, a delta type, a honeycomb type, and the like, may be positioned on the lower dielectric layer 115 to partition discharge spaces (i.e., discharge cells). Hence, a first discharge cell emitting red (R) light, a second discharge cell emitting blue (B) light, and a third discharge cell emitting green (G) light, and the like, may be positioned between the front substrate 101 and the rear substrate 111. In addition to the first, second, and third discharge cells, a fourth discharge cell emitting white (W) light or yellow (Y) light may be further positioned.

Widths of the first, second, and third discharge cells may be substantially equal to one another. Further, a width of at least one of the first, second, and third discharge cells may be different from widths of the other discharge cells. For instance, a width of the first discharge cell may be the smallest, and widths of the second and third discharge cells may be larger than the width of the first discharge cell. The width of the second discharge cell may be substantially equal to or different from the width of the third discharge cell. Hence, a color temperature of an image displayed on the plasma display panel 100 can be improved.

The plasma display panel 100 may have various forms of barrier rib structures as well as a structure of the barrier rib 112 shown in FIG. 1. For instance, the barrier rib 112 includes a first barrier rib 112*b* and a second barrier rib 112*a*. The barrier rib 112 may have a differential type barrier rib structure in which heights of the first and second barrier ribs 112*b* and 112*a* are different from each other, a channel type barrier rib structure in which a channel usable as an exhaust path is formed on at least one of the first barrier rib 112*b* or the second barrier rib 112*a*, a hollow type barrier rib structure in which a hollow is formed on at least one of the first barrier rib 112*b* or the second barrier rib 112*a*, and the like.

In the differential type barrier rib structure, a height of the first barrier rib 112*b* may be smaller than a height of the second barrier rib 112*a*. In the channel type barrier rib structure, a channel may be formed on the first barrier rib 112*b*.

While FIG. 1 has shown and described the case where the first, second, and third discharge cells are arranged on the same line, the first, second, and third discharge cells may be arranged in a different pattern. For instance, a delta type arrangement in which the first, second, and third discharge cells are arranged in a triangle shape may be applicable. Further, the discharge cells may have a variety of polygonal shapes such as pentagonal and hexagonal shapes as well as a rectangular shape.

Each of the discharge cells partitioned by the barrier ribs 112 may be filled with a discharge gas such as argon (Ar), neon (Ne), xenon (Xe), helium (He).

A phosphor layer 114 may be positioned inside the discharge cells to emit visible light for an image display during an address discharge. For instance, first, second, and third phosphor layers that produce red, blue, and green light, respectively, may be positioned inside the discharge cells. In addition to the first, second, and third phosphor layers, a fourth phosphor layer producing white and/or yellow light may be further positioned.

A thickness of at least one of the first, second, and third phosphor layers may be different from thicknesses of the other phosphor layers. For instance, a thickness of the second phosphor layer or the third phosphor layer may be larger than a thickness of the first phosphor layer. The thickness of the second phosphor layer may be substantially equal or different from the thickness of the third phosphor layer.

In FIG. 1, the upper dielectric layer 104 and the lower dielectric layer 115 each have a single-layered structure. However, at least one of the upper dielectric layer 104 or the lower dielectric layer 115 may have a multi-layered structure.

A black layer (not shown) capable of absorbing external light may be further positioned on the barrier rib 112 to prevent the external light from being reflected by the barrier rib 112. Further, another black layer (not shown) may be further positioned at a predetermined location of the front substrate 101 to correspond to the barrier rib 112.

While the address electrode 113 may have a substantially constant width or thickness, a width or thickness of the address electrode 113 inside the discharge cell may be different from a width or thickness of the address electrode 113 outside the discharge cell. For instance, a width or thickness of the address electrode 113 inside the discharge cell may be larger than a width or thickness of the address electrode 113 outside the discharge cell.

Figure 2:
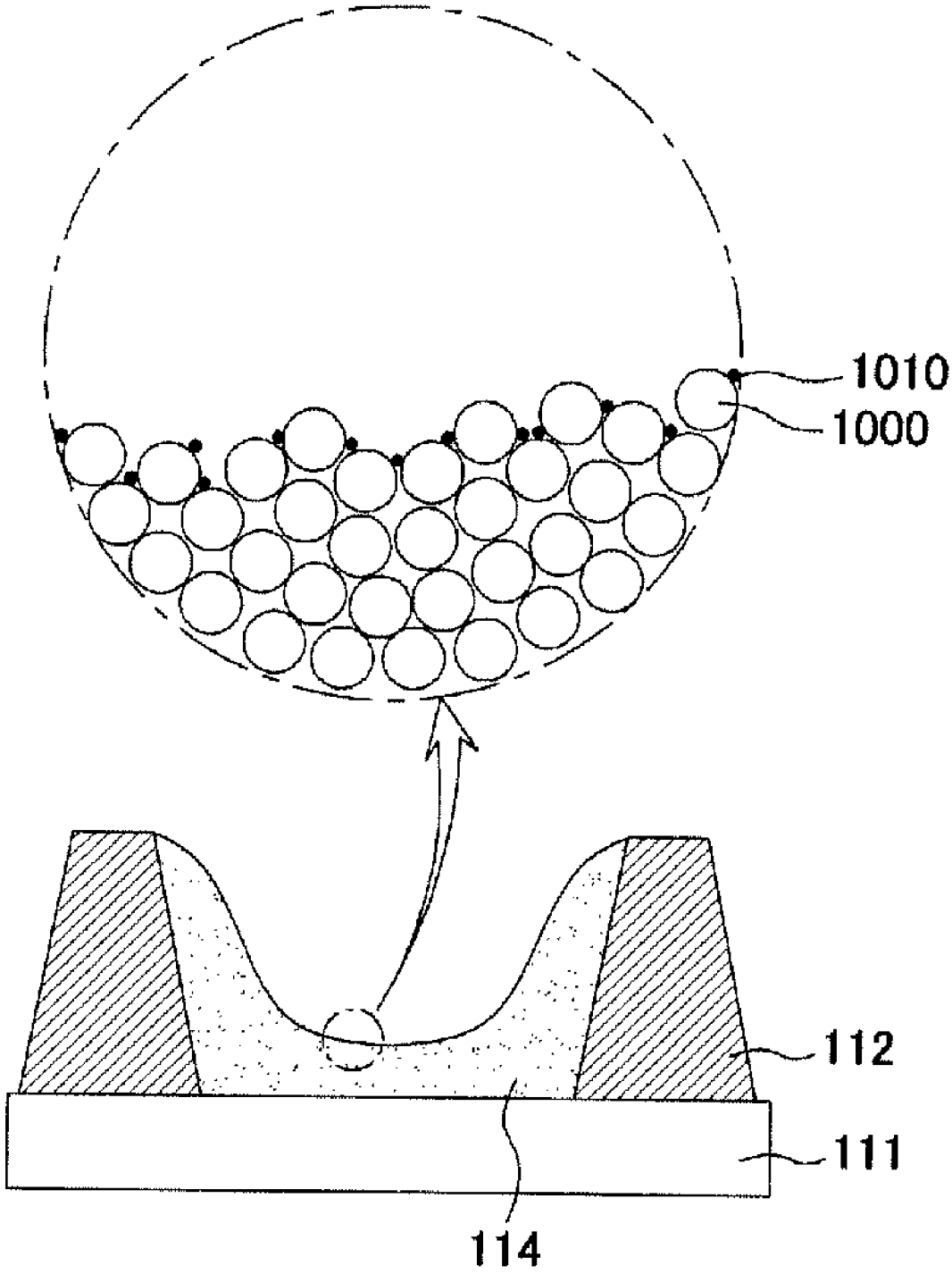
FIG. 2 shows a phosphor layer.

FIG. 2 shows a phosphor layer.

As shown in FIG. 2, the phosphor layer 114 includes particles 1000 of a phosphor material and particles 1010 of an additive material.

The particles 1010 of the additive material can improve a discharge response characteristic between the scan electrode and the address electrode or between the sustain electrode and the address electrode. This will be below described in detail.

When a scan signal is supplied to the scan electrode and a data signal is supplied to the address electrode, charges may be accumulated on the surface of the particles 1000 of the phosphor material.

If the phosphor layer 114 does not include an additive material, charges may be concentratedly accumulated on a specific portion of the phosphor layer 114 because of the nonuniform height of the phosphor layer 114 and the nonuniform distribution of the particles of the phosphor material. Hence, a relatively strong discharge may occur in the specific portion of the phosphor layer 114 on which charges are concentratedly accumulated.

Further, charges may be concentratedly accumulated in a different area of each discharge cell, and thus a discharge may occur unstably and nonuniformly. In this case, the image quality of a displayed image may worsen, and thus a viewer may watch a noise such as spots.

On the other hand, in case that the phosphor layer 114 includes the additive material such as MgO as in the exemplary embodiment, the additive material acts as a catalyst of a discharge. Hence, a discharge can stably occur between the scan electrode and the address electrode at a relatively low voltage. Accordingly, before the strong discharge occurs at a relatively high voltage in the specific portion of the phosphor layer 114, on which charges are concentratedly accumulated, a discharge can occur at a relatively low voltage in a portion of the phosphor layer 114, on which the particles of the additive material are positioned. Hence, discharge characteristics of each discharge cell can be uniform. This is caused by a reason why the additive material has a high secondary electron emission coefficient.

The additive material is not limited particularly except the improvement of the discharge response characteristic between the scan electrode and the address electrode or between the sustain electrode and the address electrode. Examples of the additive material include at least one of magnesium oxide (MgO), zinc oxide (ZnO), silicon oxide ($SiO_2$), titanium oxide ($TiO_2$), yttrium oxide ($Y_2O_3$), aluminum oxide ($Al_2O_3$), lanthanum oxide ($La_2O_3$), europium oxide (EuO), cobalt oxide, iron oxide, or CNT (carbon nano tube). It may be advantageous that the additive material is MgO.

At least one of the particles 1000 of the phosphor material on the surface of the phosphor layer 114 may be exposed in a direction toward the center of the discharge cell. For instance, since the particles 1010 of the additive material are disposed between the particles 1000 of the phosphor material on the surface of the phosphor layer 114, at least one particle 1000 of the phosphor material may be exposed.

As described above, when the particles 1010 of the additive material are disposed between the particles 1000 of the phosphor material, a discharge response characteristic between the scan electrode and the address electrode or between the sustain electrode and the address electrode can be improved. Further, since the surface area of the particles 1000 of the phosphor material covered by the particles 1010 of the additive material may be minimized, an excessive reduction in a luminance can be prevented.

Although it is not shown, if the particles 1010 of the additive material are uniformly coated on the surface of the phosphor layer 114, and a layer formed of the additive material is formed on the surface of the phosphor layer 114, the additive layer covers the most of the surface of the particles 1000 of the phosphor material. Hence, a luminance may be excessively reduced.

Figures 3, 4:
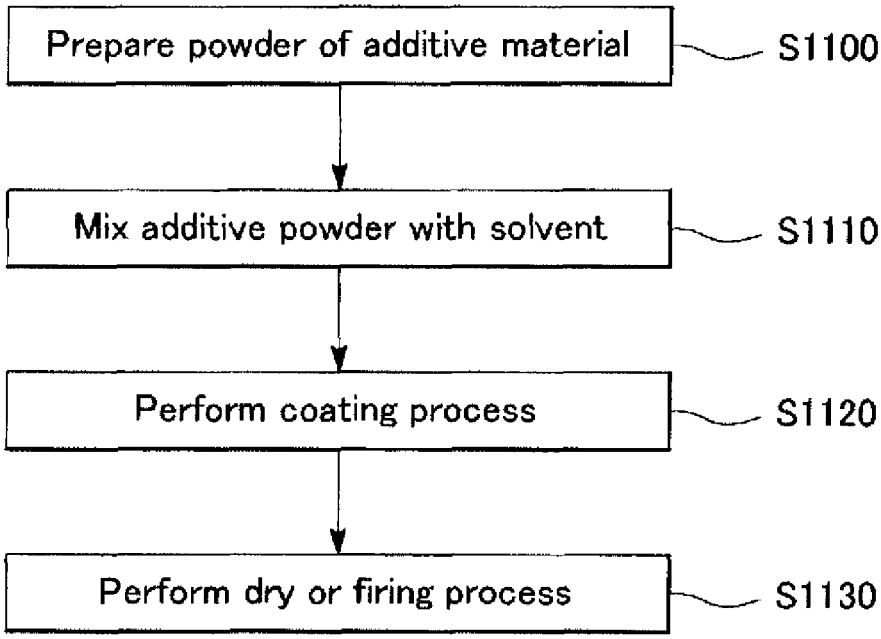
FIG. 3 illustrates an example of a method of manufacturing a phosphor layer.
FIGS. 4 and 5 are diagrams for explaining an effect of an additive material.

FIG. 3 illustrates an example of a method of manufacturing a phosphor layer.

As shown in FIG. 3, first, a powder of an additive material is prepared in step S1100. For instance, a gas oxidation process is performed on Mg vapor generated by heating Mg to form a powder of MgO.

Next, the prepared additive power is mixed with a solvent in step S1110. For instance, the resulting MgO powder is mixed with methanol to manufacture an additive paste or an additive slurry. A binder may be added so as to adjust a viscosity of the additive paste or the additive slurry.

Subsequently, the additive paste or slurry is coated on the phosphor layer in step S1120. In this case, a viscosity of the additive paste or the additive slurry is adjusted so that the particles of the additive material are smoothly positioned between the particles of the phosphor material.

Subsequently, a dry process or a firing process is performed in step S1130. Hence, the solvent mixed with the additive material is evaporated to form the phosphor layer of FIG. 2.

Figure 5:
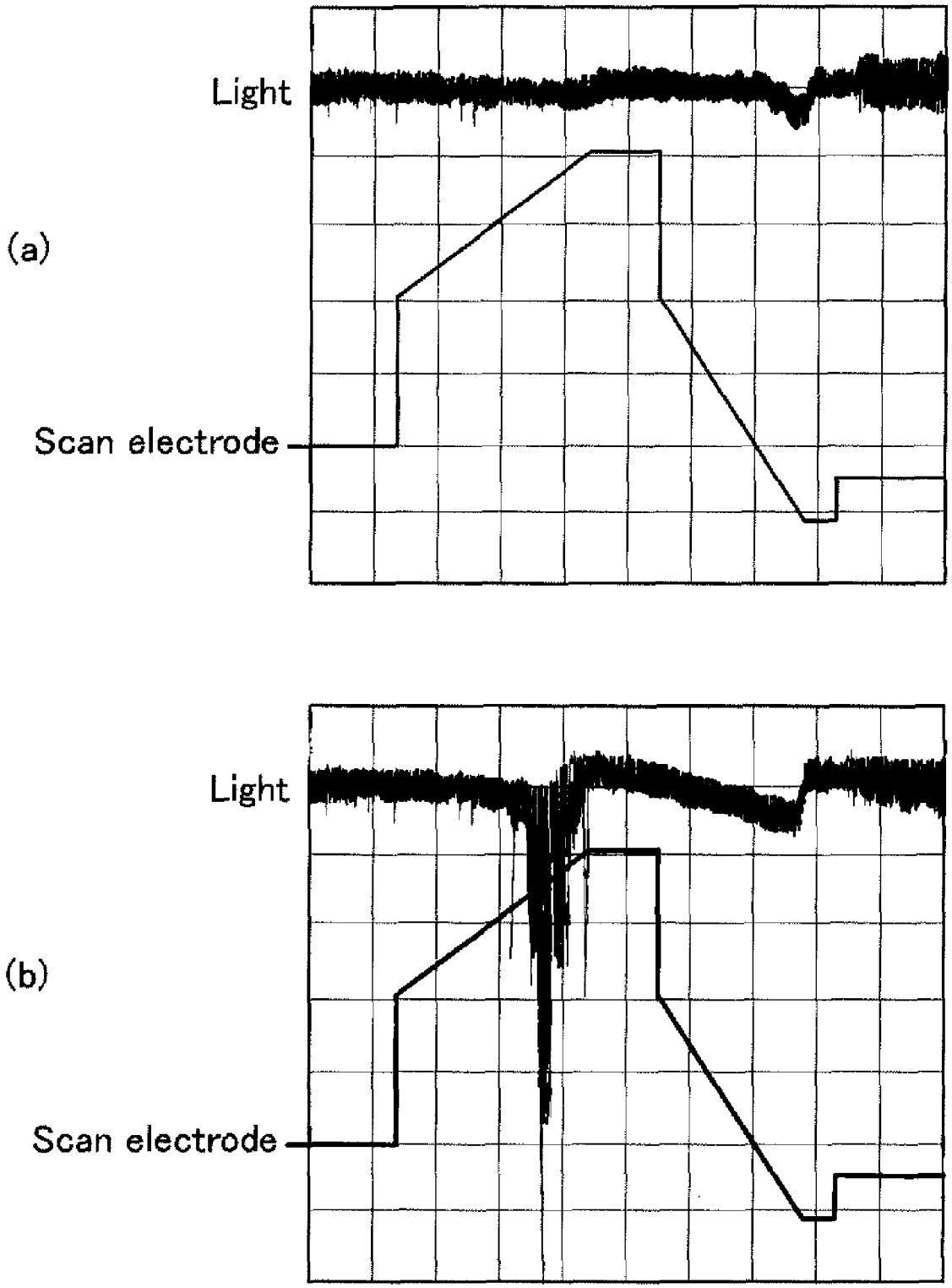

FIGS. 4 and 5 are diagrams for explaining an effect of an additive material.

FIG. 4 is a table showing a firing voltage, a luminance of a displayed image, and a bright room contrast ratio of each of a comparative example and experimental examples 1, 2 and 3. The bright room contrast ratio measures a contrast ratio in a state where an image with a window pattern occupying 45% of the screen size is displayed in a bright room. The firing voltage is a firing voltage measured between the scan electrode and the address electrode.

In the comparative example, the phosphor layer does not include an additive material.

In the experimental example 1, the phosphor layer includes MgO of 3% based on the volume of the phosphor layer as an additive material.

In the experimental example 2, the phosphor layer includes MgO of 9% based on the volume of the phosphor layer as an additive material.

In the experimental example 3, the phosphor layer includes MgO of 12% based on the volume of the phosphor layer as an additive material.

In the comparative example, the firing voltage is 135V, and the luminance is 170 cd/$m^2$.

In the experimental examples 1, 2 and 3, the firing voltage is 127V to 129V lower than the firing voltage of the comparative example, and the luminance is 176 cd/$m^2$ to 178 cd/$m^2$ higher than the luminance of the comparative example. Because the particles of the MgO material as the additive material in the experimental examples 1, 2 and 3 act as a catalyst of a discharge, the firing voltage between the scan electrode and the address electrode is lowered. Furthermore, in the experimental examples 1, 2 and 3, because an intensity of a discharge generated at the same voltage as the comparative example increases due to a fall in the firing voltage, the luminance further increases.

While the bright room contrast ratio of the comparative example is 55:1, the bright room contrast ratio of the experimental examples 1, 2 and 3 is 58:1 to 61:1. As can be seen from FIG. 4, a contrast characteristic of the experimental examples 1, 2 and 3 is more excellent than that of the comparative example.

In the experimental examples 1, 2 and 3, a uniform discharge occurs at a lower firing voltage than that of the comparative example, and thus the quantity of light during a reset period is relatively small in the experimental examples 1, 2 and 3.

In FIG. 5, (a) is a graph showing the quantity of light in the experimental examples 1, 2 and 3, and (*b*) is a graph showing the quantity of light in the comparative example.

As shown in (b) of FIG. 5, because an instantaneously strong discharge occurs at a relatively high voltage in the comparative example not including the MgO material, the quantity of light may instantaneously increase. Hence, the contrast characteristics may worsen.

As shown in (a) of FIG. 5, because a discharge occurs at a relatively low voltage in the experimental examples 1, 2 and 3 including the MgO material, a weak reset discharge continuously occurs during a reset period. Hence, a small quantity of light is generated, and the contrast characteristics can be improved.

Figure 6:
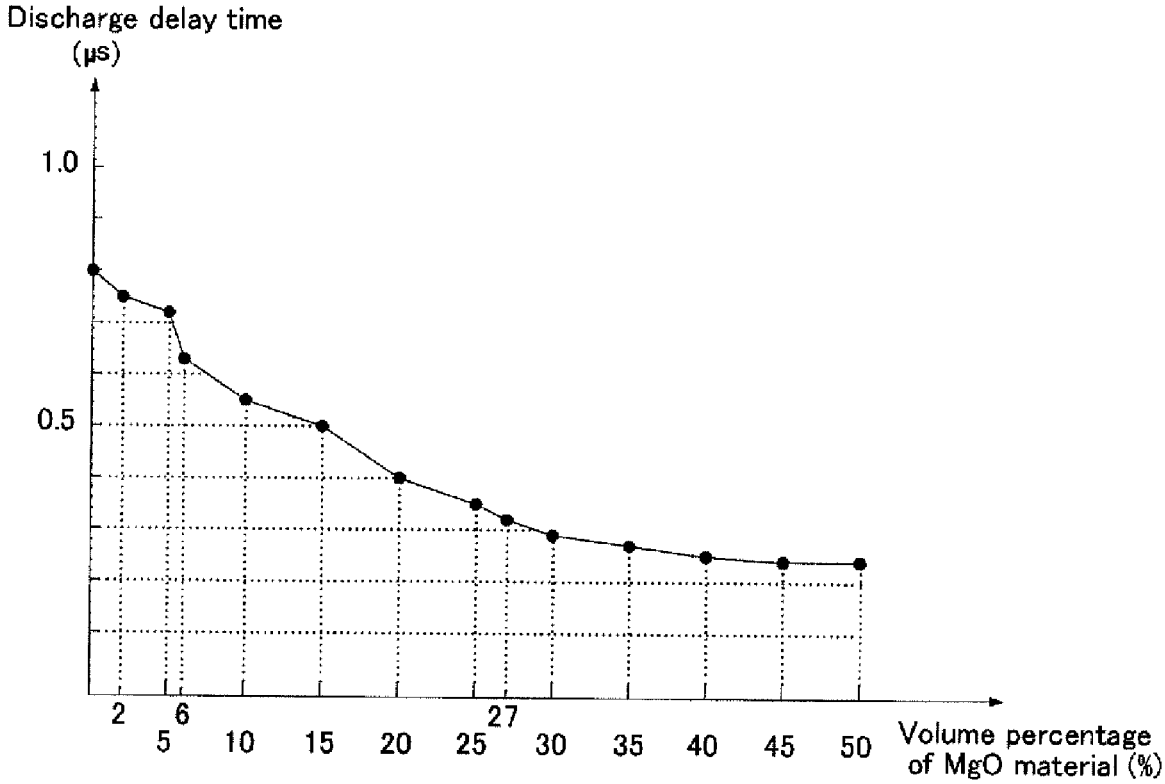
FIG. 6 is a diagram for explaining a content of an additive material.

FIG. 6 is a graph measuring a discharge delay time of an address discharge while a percentage of a volume of MgO material used as an additive material based on the volume of the phosphor layer changes from 0% to 50%.

The address discharge delay time means a time interval between a time when the scan signal and the data signal are supplied during an address period and a time when an address discharge occurs between the scan electrode and the address electrode.

As shown in FIG. 6, when the volume percentage of the MgO material is 0 (in other words, when the phosphor layer does not include MgO material), the discharge delay time may be approximately 0.8 μs.

When the volume percentage of the MgO material is 2%, the discharge delay time is reduced to be approximately 0.75 μs. In other words, because the particles of the MgO material improve a discharge response characteristic between the scan electrode and the address electrode, an address jitter characteristic can be improved.

Further, when the volume percentage of the MgO material is 5%, the discharge delay time may be approximately 0.72 μs. When the volume percentage of the MgO material is 6%, the discharge delay time may be approximately 0.63 μs.

When the volume percentage of the MgO material lies in a range between 10% and 50%, the discharge delay time may be reduced from approximately 0.55 μs to 0.24 μs.

It can be seen from the graph of FIG. 6 that as a content of the MgO material increases, the discharge delay time can be reduced. Hence, the address jitter characteristic can be improved. However, an improvement width of the address jitter characteristic may gradually decrease. In case that the volume percentage of the MgO material is equal to or more than 40%, a reduction width of the discharge delay time may be small.

On the other hand, in case that the volume percentage of the MgO material is excessively large, the particles of the MgO material may excessively cover the surface of the particles of the phosphor material. Hence, a luminance may be reduced.

Accordingly, the percentage of the volume of the MgO material based on the volume of the phosphor layer may lie substantially in a range between 2% and 40% or between 6% and 27% so as to reduce the discharge delay time and to prevent an excessive reduction in the luminance.

Figure 7:
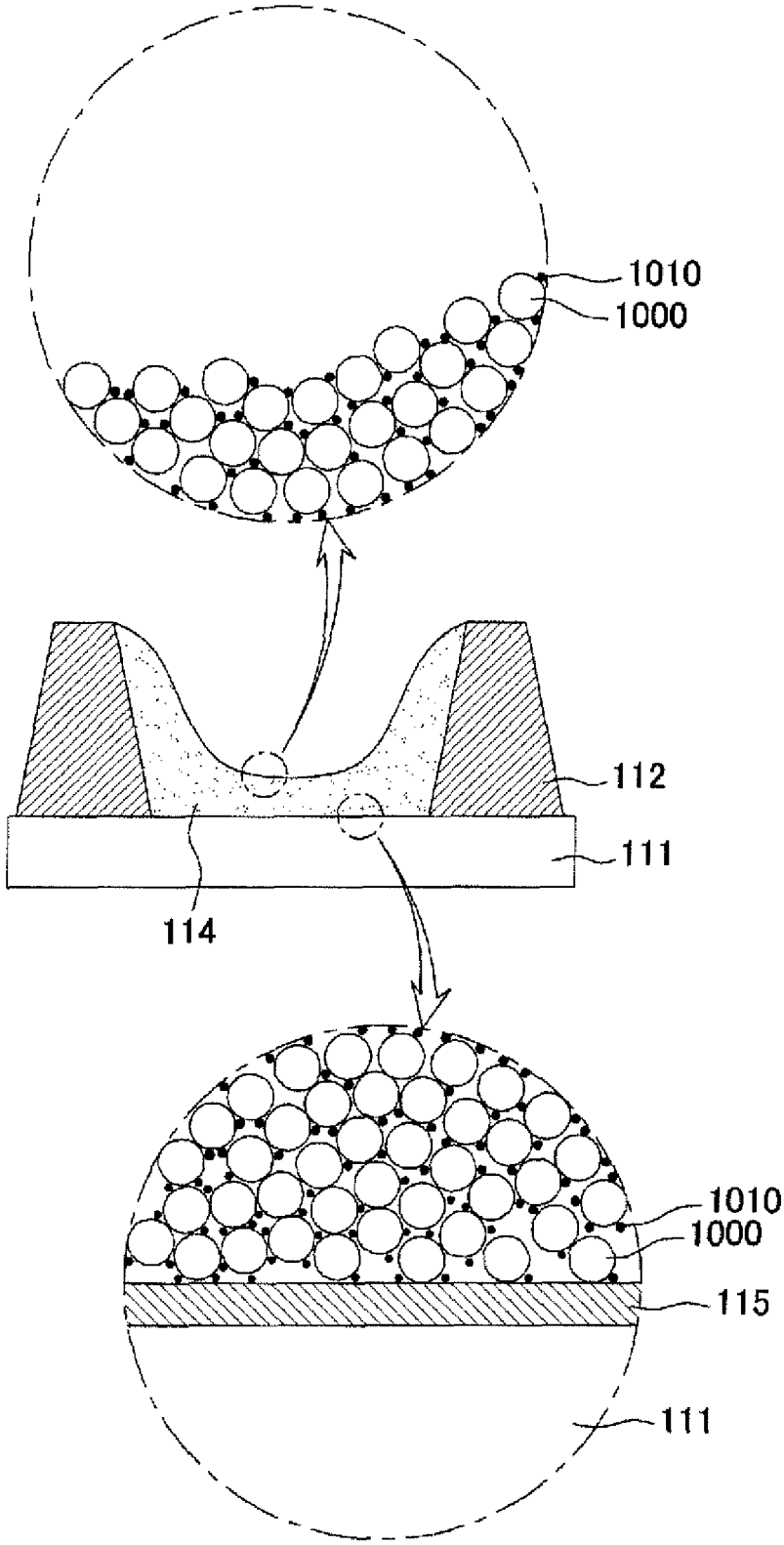
FIG. 7 shows another structure of a phosphor layer.

FIG. 7 shows another structure of a phosphor layer.

As shown in FIG. 7, the particles 1010 of the additive material may be positioned on the surface of the phosphor layer 114, inside the phosphor layer 114, and between the phosphor layer 114 and the lower dielectric layer 115.

When the particles 1010 of the additive material may be positioned on the surface of the phosphor layer 114, inside the phosphor layer 114, and between the phosphor layer 114 and the lower dielectric layer 115, a discharge response characteristic between the scan electrode and the address electrode or between the sustain electrode and the address electrode can be improved.

Figure 8:
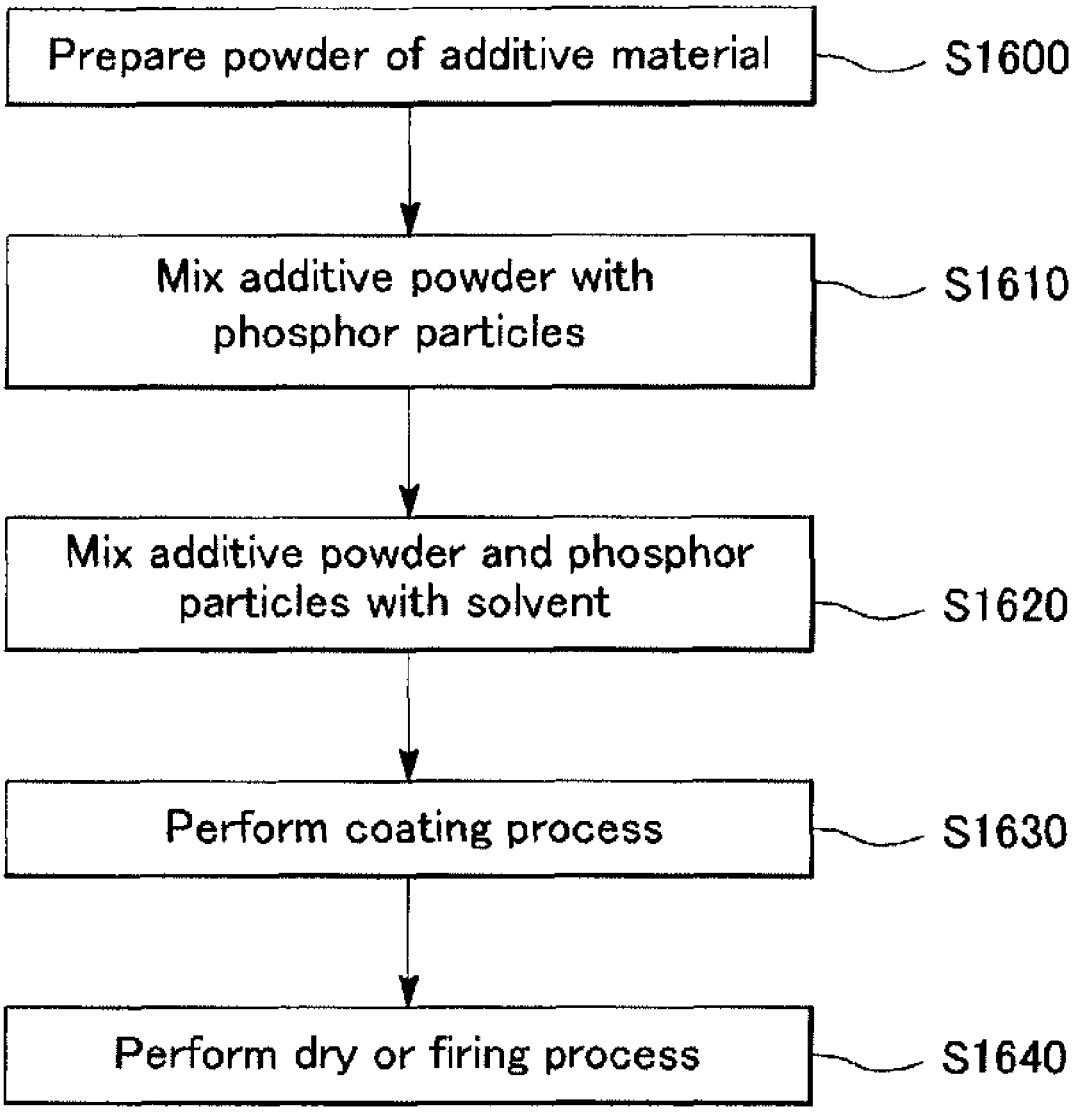
FIG. 8 illustrates an example of a method of manufacturing a phosphor layer of FIG. 7.

FIG. 8 illustrates an example of a method of manufacturing the phosphor layer having the structure shown in FIG. 7.

As shown in FIG. 8, a powder of an additive material is prepared in step S1600.

The prepared additive power is mixed with phosphor particles in step S1610.

The additive power and the phosphor particles are mixed with a solvent in step S1620.

The additive power and the phosphor particles mixed with the solvent are coated inside the discharge cells in step S1630. In the coating process, a dispensing method may be used.

A dry process or a firing process is performed in step S1640 to evaporate the solvent. Hence, the phosphor layer having the structure shown in FIG. 7 is formed.

Figure 9:
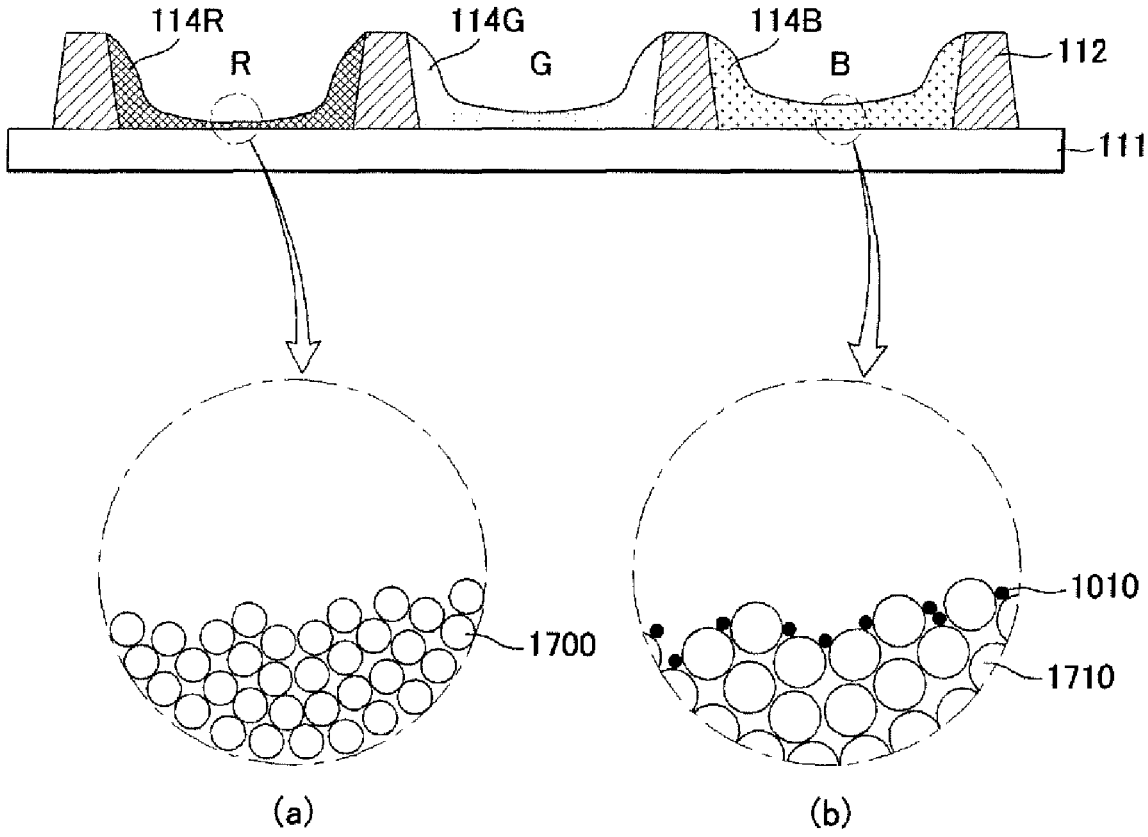
FIG. 9 is a diagram for explaining a method of selectively using an additive material.

FIG. 9 is a diagram for explaining a method of selectively using an additive material.

As shown in FIG. 9, the phosphor layer includes a first phosphor layer 114R emitting red light, a second phosphor layer 114B emitting blue light, and a third phosphor layer 114G emitting green light. The additive material may not be omitted in at least one of the first phosphor layer 114R, the second phosphor layer 114B, or the third phosphor layer 114G.

For instance, as shown in (a), the first phosphor layer 114R includes particles 1700 of a first phosphor material, but does not include an additive material. As shown in (b), the second phosphor layer 114B includes particles 1710 of a second phosphor material and particles 1010 of an additive material. In this case, the quantity of light generated in the second phosphor layer 114B can increase, and thus a color temperature can be improved.

The size of the particles 1710 of the second phosphor material in (b) may be larger than the size of the particles 1700 of the first phosphor material in (a). In this case, a discharge in the second phosphor layer 114B in (b) may be more unstable than a discharge in the first phosphor layer 114R in (a). However, because the second phosphor layer 114B includes the particles 1010 of the additive material, the discharge in the second phosphor layer 114B can be stabilized.

In case that the phosphor layer includes the additive material, the degradation of the phosphor layer may be accelerated. More specifically, because the additive material has a relatively high secondary electron emission coefficient, the additive material can discharge the large amount of charges from the discharge cell, and thus the large amount of charges may be positioned on the surface of the phosphor layer. The large amount of charges on the surface of the phosphor layer collides with the phosphor layer during a discharge, and thus can accelerate the degradation of the phosphor layer. Hence, life span of the panel can be shortened. A degradation speed of the phosphor layer (i.e., a sputtering speed) may be inversely proportional to a pressure of the discharge gas.

Accordingly, the pressure of the discharge gas injected into the panel may increase so as to prevent life span of the panel from being shortened by the additive material.

FIG. 10 is a table showing the amount of a noise measured when a pressure of the discharge gas filled in the plasma display panel is approximately 400 torr, 420 torr, 460 torr, 500 torr, 550 torr, and 600 torr, respectively.

A noise measuring device is installed at 1 m ahead of the panel to measure a noise generated in the panel.

As shown in FIG. 10, when a pressure of the discharge gas is approximately 400 torr, a noise at each frequency of 500 Hz, 1 kHz, 2 kHz, 4 kHz, 8 kHz, and 16 kHz during a drive is approximately 16.1 dB, 16 dB, 15.4 dB, 13.7 dB, 12.4 dB, and 10.5 dB, respectively.

When a pressure of the discharge gas is approximately 420 torr, a noise at each frequency of 500 Hz, 1 kHz, 2 kHz, 4 kHz, 8 kHz, and 16 kHz is approximately 16.6 dB, 18.6 dB, 18.8 dB, 17.2 dB, 16.7 dB, and 16.3 dB, respectively. When a pressure of the discharge gas is approximately 460 torr, a noise at each frequency of 500 Hz, 1 kHz, 2 kHz, 4 kHz, 8 kHz, and 16 kHz is approximately 16.2 dB, 18 dB, 18.2 dB, 17.7 dB, 17.4 dB, and 17.1 dB, respectively. When a pressure of the discharge gas is approximately 500 torr, a noise at each frequency of 500 Hz, 1 kHz, 2 kHz, 4 kHz, 8 kHz, and 16 kHz is approximately 17.7 dB, 18.9 dB, 19.1 dB, 19.2 dB, 19.5 dB, and 19.7 dB, respectively.

On the other hand, when a pressure of the discharge gas is approximately 550 torr, a noise at each frequency of 500 Hz, 1 kHz, 2 kHz, 4 kHz, 8 kHz, and 16 kHz is approximately 20.7 dB, 22.4 dB, 21.8 dB, 27.4 dB, 35.3 dB, and 34 dB, respectively. When a pressure of the discharge gas is approximately 600 torr, a noise at each frequency of 500 Hz, 1 kHz, 2 kHz, 4 kHz, 8 kHz, and 16 kHz is approximately 27.6 dB, 28.2 dB, 26.9 dB, 31.2 dB, 33.4 dB, and 34.1 dB, respectively.

Considering the table of FIG. 10, when the pressure of the discharge gas filled in the plasma display panel is equal to or lower than approximately 500 torr, the noise generated throughout all the frequencies has a relatively small value equal to or less than 20 dB. On the other hand, when the pressure of the discharge gas has a relatively high value equal to or higher than approximately 550 torr, the noise generated throughout all the frequencies has a relatively large value equal to or more than 20 dB. Moreover, a large amount of noise may occur at each frequency of 8 kHz or 16 kHz.

This can be interpreted as the fact that as a pressure inside the plasma display panel is high, a relatively large amount of noise occurs by the collision between the front substrate and the barrier rib through a vibration generated during a drive.

Accordingly, the pressure inside the panel (i.e., the pressure of the discharge gas) may lie substantially in a range between 400 torr and 500 torr or between 420 torr and 460 torr so as to reduce the noise and to prevent the degradation of the phosphor layer.

The particles of the MgO material included in the phosphor layer may have one orientation or two or more different orientations. For instance, only (200)-oriented MgO material may be used, or (200)- and (111)-oriented MgO material may be used. However, (200)-oriented MgO material and (111)-oriented MgO material may be together used so as to improve a discharge response characteristic between the scan electrode and the address electrode or between the sustain electrode and the address electrode and to prevent the degradation of the phosphor layer.

For instance, while the (111)-oriented MgO material has a relatively higher secondary electron emission coefficient than the (200)-oriented MgO material, the (111)-oriented MgO material has a relatively weaker sputter resistance than the (200)-oriented MgO material. Further, wall charges accumulating characteristic of the (111)-oriented MgO material is weaker than that of the (200)-oriented MgO material.

Accordingly, in case that only the (111)-oriented MgO material is used, it is possible to improve a discharge response characteristic between the scan electrode and the address electrode or between the sustain electrode and the address electrode. However, it is difficult to prevent the degradation of the phosphor layer.

On the other hand, in case that only the (200)-oriented MgO material is used, it is possible to prevent the degradation of the phosphor layer. However, it is difficult to improve a discharge response characteristic between the scan electrode and the address electrode or between the sustain electrode and the address electrode.

Accordingly, the (200)-oriented MgO material and the (111)-oriented MgO material may be together used so as to improve the discharge response characteristic between the scan electrode and the address electrode or between the sustain electrode and the address electrode and to prevent the degradation of the phosphor layer.

When the pressure of the discharge gas is considered so as to prevent the particles of the phosphor layer including the MgO material from being excessively degraded, a content of the (200)-oriented MgO material having the relatively stronger sputter resistance may be more than a content of the (111)-oriented MgO material.

Figure 11:
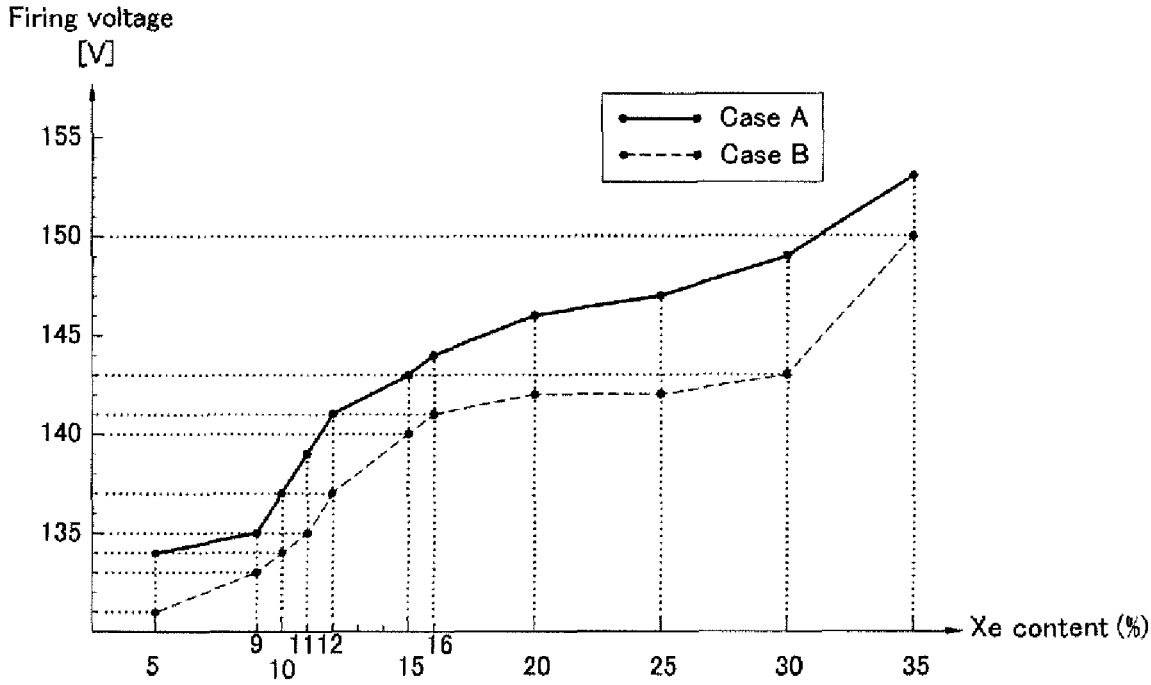
FIG. 11 is a graph showing a relationship between Xe content and a firing voltage.

FIG. 11 is a graph showing a firing voltage between the scan electrode and the sustain electrode in two cases A and B when a content of Xe included in the discharge gas changes from 5% to 35% based on weight of the discharge gas. In the case A, the phosphor layer does not include an additive material. In the case B, the phosphor layer includes an additive material.

As shown in FIG. 11, in the case A, when the Xe content is approximately 5%, a firing voltage between the scan and sustain electrodes is approximately 134V. When the Xe content is approximately 9%, the firing voltage has a relatively low value of approximately 135V. On the other hand, when the Xe content is approximately 10%, the firing voltage increases to approximately 137V.

Further, when the Xe content is approximately 11%, the firing voltage is approximately 139V. When the Xe content ranges from 12% to 15%, the firing voltage ranges from approximately 141V to 143V.

When the Xe content ranges from 16% to 30%, the firing voltage ranges from approximately 144V to 149V. When the Xe content is equal to or more than 35%, the firing voltage sharply increases to approximately 153V or more.

As can be seen from FIG. 11, as the Xe content increases, the firing voltage between the scan and sustain electrodes rises.

In the case B, when the Xe content is approximately 5%, a firing voltage between the scan and sustain electrodes is approximately 131V. When the Xe content is approximately 9%, the firing voltage has a relatively low value of approximately 133V. On the other hand, when the Xe content is approximately 10%, the firing voltage increases to approximately 134V.

Further, when the Xe content is approximately 11%, the firing voltage is approximately 135V. When the Xe content ranges from 12% to 15%, the firing voltage ranges from approximately 137V to 140V.

When the Xe content ranges from 16% to 30%, the firing voltage ranges from approximately 141V to 143V. When the Xe content is equal to or more than 35%, the firing voltage sharply increases to approximately 150V or more.

In other words, because the phosphor layer includes the additive material, a sharp rise in the firing voltage between the scan electrode and the sustain electrode can be prevented even if the Xe content increases.

Figure 12:
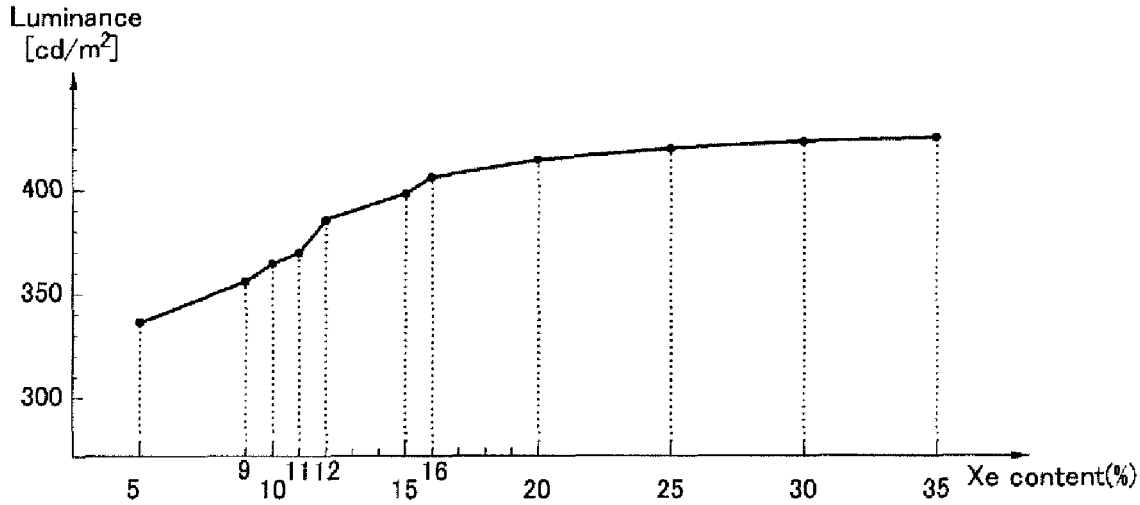
FIG. 12 is a graph showing a relationship between Xe content and a luminance.

FIG. 12 is a graph showing a luminance measured when a window pattern occupying 25% of the screen size is displayed on the screen while a content of Xe included in the discharge gas changes from 5% to 35% based on weight of the discharge gas.

As shown in FIG. 12, when the Xe content is approximately 5%, a luminance of a displayed image is approximately 338 cd/m$^2$. When the Xe content is approximately 9%, a luminance is approximately 356 cd/m$^2$ and is relatively low.

When the Xe content is approximately 10%, a luminance increases to approximately 364 cd/m$^2$. Since Xe increases the generation amount of vacuum ultraviolet rays during a discharge, the quantity of light generated in the discharge cell increases due to an increase in the Xe content. Hence, the luminance can increase.

When the Xe content is approximately 11%, a luminance is approximately 370 cd/m$^2$. When the Xe content ranges from approximately 12% to 15%, a luminance has a high value ranging from approximately 384 cd/m$^2$ to 399 cd/m$^2$.

When the Xe content ranges from approximately 16% to 30%, a luminance ranges from approximately 406 cd/m$^2$ to 423 cd/m$^2$. When the Xe content is equal to or more than 35%, a luminance is approximately 425 cd/m$^2$.

As can be seen from FIG. 12, as the Xe content increases, the luminance of the displayed image increases. On the other hand, when the Xe content is equal to or more than 35%, an increase width in the luminance is small.

Considering the graphs of FIGS. 11 and 12, the discharge gas may include Xe of 10% to 30% or 12% to 20% based on weight of the discharge gas so as to improve the luminance and to prevent an excessive rise in the firing voltage between the scan electrode and the sustain electrode.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A plasma display panel comprising:

a front substrate;

a rear substrate positioned opposite the front substrate;

a phosphor layer positioned between the front substrate and the rear substrate;

a barrier rib positioned between the front substrate and the rear substrate; and a discharge gas between the front substrate and the rear substrate, wherein the phosphor layer includes a phosphor material and an additive material, and the additive material includes (200)-oriented MgO material and (111)-oriented MgO material, and a content of the (111)-oriented MgO material is less than a content of (200)-oriented MgO material.

2. The plasma display panel of claim 1, wherein at least one of particles of the additive material is positioned on the surface of the phosphor layer.

3. The plasma display panel of claim 1, further comprising a lower dielectric layer between the phosphor layer and the barrier rib and the rear substrate, wherein at least one of particles of the additive material is positioned between the phosphor layer and the lower dielectric layer.

4. The plasma display panel of claim 1, wherein a percentage of a volume of the additive material based on a volume of the phosphor layer lies substantially in a range between 2% and 40%.

5. The plasma display panel of claim 1, wherein the phosphor layer includes a first phosphor layer emitting red light, a second phosphor layer emitting blue light, and a third phosphor layer emitting green light, and the additive material is omitted in at least one of the first phosphor layer, the second phosphor layer, or the third phosphor layer.

6. The plasma display panel of claim 1, wherein the phosphor layer includes a first phosphor layer emitting red light, a second phosphor layer emitting blue light, and a third phosphor layer emitting green light, and the MgO material is omitted in at least one of the first phosphor layer, the second phosphor layer, or the third phosphor layer.

7. The plasma display panel of claim 1, wherein the discharge gas is filled between the front substrate and the rear substrate.

8. The plasma display panel of claim 7, wherein the discharge gas is filled within an entire space between the front substrate and the rear substrate.

9. A plasma display panel comprising: a front substrate; a rear substrate positioned opposite the front substrate; a phosphor layer positioned between the front substrate and the rear substrate; a barrier rib positioned between the front substrate and the rear substrate; and a discharge gap between the front substrate and the rear substrate; wherein the phosphor layer includes a phosphor material and an additive material, and the additive material includes at least one of titanium oxide ($TiO_2$), yttrium oxide ($Y_2O_3$), europium oxide (EuO), cobalt oxide, and iron oxide; wherein the additive material includes MgO material, and the MgO material includes (200)-oriented MgO material and (111)-oriented MgO material, and a content of the (111)-oriented MgO material is less than a content of (200)-oriented MgO material.

10. The plasma display panel of claim 9, wherein at least one of particles of the additive material is positioned on the surface of the phosphor layer.

11. The plasma display panel of claim 9, further comprising a lower dielectric layer between the phosphor layer and the barrier rib and the rear substrate, wherein at least one of particles of the additive material is positioned between the phosphor layer and the lower dielectric layer.

12. The plasma display panel of claim 9, wherein a percentage of a volume of the additive material based on a volume of the phosphor layer lies substantially in a range between 2% and 40%.

13. The plasma display panel of claim 9, wherein the phosphor layer includes a first phosphor layer emitting red light, a second phosphor layer emitting blue light, and a third phosphor layer emitting green light, and the additive material is omitted in at least one of the first phosphor layer, the second phosphor layer, or the third phosphor layer.

14. The plasma display panel of claim 9, wherein a pressure of the discharge gas lies substantially in a range between 400 torr and 500 torr.

15. The plasma display panel of claim 9, wherein discharge gas includes xenon (Xe) of 10% to 30% based on weight of the discharge gas.

16. The plasma display panel of claim 9, wherein the discharge gas is filled between the front substrate and the rear substrate.

17. The plasma display panel of claim 16, wherein the discharge gas is filled within an entire space between the front substrate and the rear substrate.

18. A plasma display panel comprising:

a front substrate;

a rear substrate positioned opposite the front substrate;

a phosphor layer positioned between the front substrate and the rear substrate;

a barrier rib positioned between the front substrate and the rear substrate; and a discharge gas between the front substrate and the rear substrate, wherein the phosphor layer includes a phosphor material and MgO material, and a pressure of the discharge gas lies substantially in a range between 400 torr and 500 torr and wherein the MgO material includes (200)-oriented MgO material and (111)-oriented MgO material, and a content of the (111)-oriented MgO material is less than a content of (200)-oriented MgO material.

19. The plasma display panel of claim 18, wherein at least one of particles of the MgO material is positioned on the surface of the phosphor layer.

20. The plasma display panel of claim 18, further comprising a lower dielectric layer between the phosphor layer and the barrier rib and the rear substrate, wherein at least one of particles of the MgO material is positioned between the phosphor layer and the lower dielectric layer.

21. The plasma display panel of claim 18, wherein a percentage of a volume of the MgO material based on a volume of the phosphor layer lies substantially in a range between 2% and 40%.

22. The plasma display panel of claim 18, wherein the discharge gas includes xenon (Xe) of 10% to 30% based on weight of the discharge gas.

23. The plasma display panel of claim 18, wherein the discharge gas is filled between the front substrate and the rear substrate.

24. The plasma display panel of claim 23, wherein the discharge gas is filled within an entire space between the front substrate and the rear substrate.

25. A plasma display panel comprising:

a front substrate;

a rear substrate positioned opposite the front substrate;

a phosphor layer positioned between the front substrate and the rear substrate;

a barrier rib positioned between the front substrate and the rear substrate; and a discharge gas between the front substrate and the rear substrate, wherein:

the phosphor layer includes a phosphor material and an additive material, the additive material includes (200)-oriented MgO material and (111)-oriented MgO material, a content of the (111)-oriented MgO material is less than a content of (200)-oriented MgO material, and a percentage of a volume of the additive material based on a volume of the phosphor layer lies substantially in a range between 2% and 40%.

26. A plasma display panel comprising:

a front substrate;

a rear substrate positioned opposite the front substrate;

a phosphor layer positioned between the front substrate and the rear substrate;

a barrier rib positioned between the front substrate and the rear substrate; and a discharge gas between the front substrate and the rear substrate, wherein:

the phosphor layer includes a phosphor material and MgO material, a pressure of the discharge gas lies substantially in a range between 400 torr and 500 torr, the MgO material includes (200)-oriented MgO material and (111)-oriented MgO material, a content of the (111)-oriented MgO material is less than a content of (200)-oriented MgO material, and a percentage of a volume of the MgO material based on a volume of the phosphor layer lies substantially in a range between 2% and 40%.

* * * * *